US005357047A

United States Patent [19]

Isozaki et al.

[11] Patent Number: 5,357,047

[45] Date of Patent: Oct. 18, 1994

[54] METHOD AND DEVICE FOR CONVERTING SOURCE PIANO PLAYING DATA FOR AUTOMATIC PLAYING PIANO

[75] Inventors: Yoshimasa Isozaki; Shinya Koseki, both of Hamamatsu, Japan

[73] Assignee: Yamaha Corporation, Hamamatsu, Japan

[21] Appl. No.: 904,172

[22] Filed: Jun. 25, 1992

[30] Foreign Application Priority Data

Jun. 26, 1991 [JP] Japan ..... 3-154460

[51] Int. Cl.[5] ..... G10F 5/00

[52] U.S. Cl. ..... 84/47; 84/737; 84/21

[58] Field of Search ..... 84/13, 33, 21, 47, 737, 84/174, 216

[56] References Cited

U.S. PATENT DOCUMENTS 4,469,000 9/1984 Fujiwara et al. .
4,913,026 4/1990 Kaneko et al. ..... 84/21
4,970,928 11/1990 Tamaki ..... 84/21
5,022,301 6/1991 Stahnke ..... 84/21
5,164,532 11/1992 Ishii et al. ..... 84/21 X
5,200,562 4/1993 Kaneko et al. ..... 84/21

*Primary Examiner*—William M. Shoop, Jr.
*Assistant Examiner*—Jeffrey W. Donels
*Attorney, Agent, or Firm*—Graham & James

[57] ABSTRACT

Converting method comprising a detecting step for detecting a movement of an action of a piano, calculating step for calculating playing data depending on the movement of the action, correcting step for correcting at least string-striking intensity data in the automatic playing data based on the compared result playing data, recording step for recording the corrected data as the automatic playing data. Furthermore, converting device comprises detecting member for detecting a position of a hammer, calculating member for calculating playing data depending on a position of a hammer, correcting member for correcting the playing data, recording member for recording the corrected data, and driving member for driving a key. The method and device compensates the errors of playing data resulted by a difference of a piano's type or by changing shape of parts in an action, because data is corrected by ratios of lengths of the parts of the piano.

3 Claims, 3 Drawing Sheets

METHOD AND DEVICE FOR CONVERTING SOURCE PIANO PLAYING DATA FOR AUTOMATIC PLAYING PIANO

BACKGROUND OF THE INVENTION

1. Field of the Invention

The present invention relates to a converting method and device of musical playing data in automatic playing piano that is capable of playing automatically according to stored automatic playing data.

2. Background of the Invention

There have been automatic playing pianos that are capable of playing automatically by driving keys and pedals of the pianos using solenoids. The automatic playing data for enabling the pianos to automatically play can be obtained by the method that an actual piano having sensors for detecting state of the keys and the pedals is played as a source piano, and that the data detected by the sensors during the playing is successively stored in a memory.

Generally, big pianos, such as a concert piano played in halls or the like, are used for the source pianos for gathering the data. Many pianos used in ordinary homes are smaller pianos than the concert grand pianos or the like, such as an upright piano. There are various differences between both type pianos structurally, and if the same music is played in both, the proper playing condition (key touch intensity or the like) is different between them because of general different playing places.

The automatic playing data, however, is stored in a memory as the data originally representative of playing state, such as string-striking intensity, in the source piano, and the automatic playing piano (destination piano) plays the data without any modification, so that if the type of the source piano is different from that of the automatic playing piano, each of the expressions of music is quite different. For example, the velocity immediately before the string being struck by the hammer in the source piano is applied to the automatic playing piano, resulting in a big difference of the expression.

SUMMARY OF THE INVENTION

It is therefore an object of the present invention to provide a converting method of playing data in automatic playing pianos, which allows the pianos to exceed more in the expression by correcting the difference between the source piano and the automatic playing piano.

In accordance with the present invention, a converting method of playing data in an automatic playing piano comprises the steps of comparing at least mechanical data of a source piano for detecting playing data corresponding to actual playing and an automatic playing piano for automatic playing, recording the playing data as automatic playing data, and correcting at least string-striking intensity data in the automatic playing data based on the compared result.

The conversion of the data (correction of the data) can be performed during the recording step. Also, it is possible to convert the data in the automatic playing piano immediately before playing back, by recording the mechanical data of the source piano together with the playing data thereof. The conversion can be performed at any timing including the record timing and the playback timing and any device.

DETAILED DESCRIPTION OF THE PREFERRED EMBODIMENTS

Figure 1:
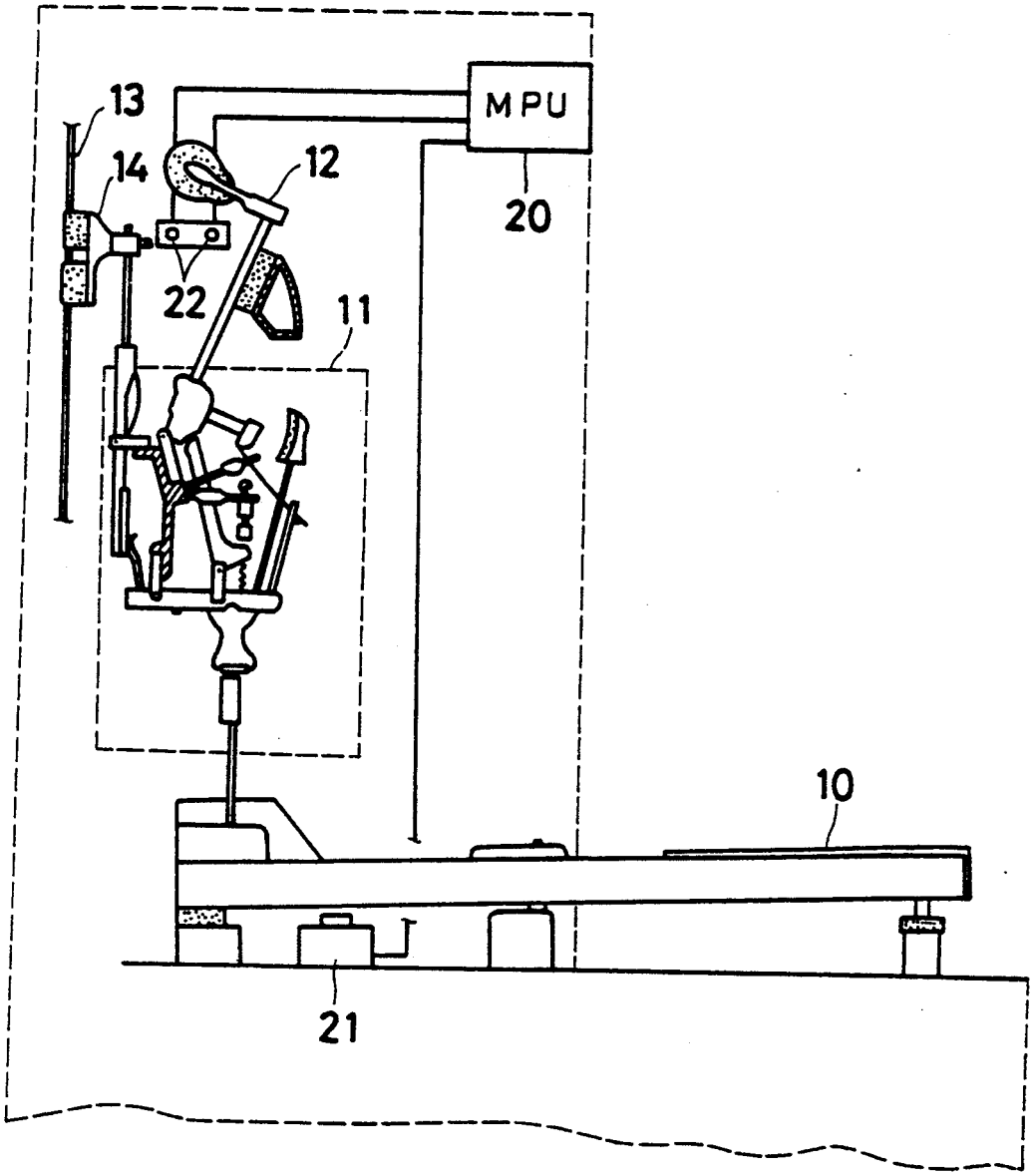
FIG. 1 illustrates a schematic structure of a hammer-action part and its environs of an automatic playing piano that the present invention is applied.

FIG. 1 illustrates a schematic structure of a hammer-action part and its environs of an automatic playing piano that the present invention is applied. This hammer-action part is a part of an upright piano. A key 10 is connected to an action mechanism 11, and the action mechanism 11 drives a hammer 12 and a damper 14 according to movement of the key 10. That is, while the key 10 isn't depressed, the damper 14 is touched to a string 13 to thereby suppress the vibration of the string 13, and the hammer 12 is located apart from the string 13. When the key 10 is depressed, the damper 14 moves apart from the string 13, and therefore, the hammer 12 hits the string 13 at a speed corresponding to the depressed speed of the key 10. As a result, the string 13 is driven as to vibrate, resulting in generation of musical tones. A solenoid 21 is provided in the lower part of the key 10, and the solenoid 21 is connected to a micro processor 20. The micro processor 20 reads the automatic playing data from a memory and drives the solenoid 21 depending on the data. When the solenoid 21 is driven, the key 10 moves like the key 10 is actually depressed by a player. The above-mentioned structure is applied to every key (eighty-eight keys including black keys) of the automatic playing piano.

The automatic playing data is data which instructs a solenoid location, driving timing and a driving velocity (an amount of current), the micro processor 20 reads the data and drives the solenoid 21 according to the data. Therefore, the automatic playing is performed.

A hammer sensor 22 is provided in a stroke range where the hammer 12 strikes the string 13. The hammer sensor 22 includes two photo sensors for detecting a velocity of the hammer 12. When the actual playing is recorded in the source piano, the string-striking intensity data is detected according to the detected velocity.

It is possible to apply the similar structure to the above mentioned structure to grand pianos.

Figure 2:
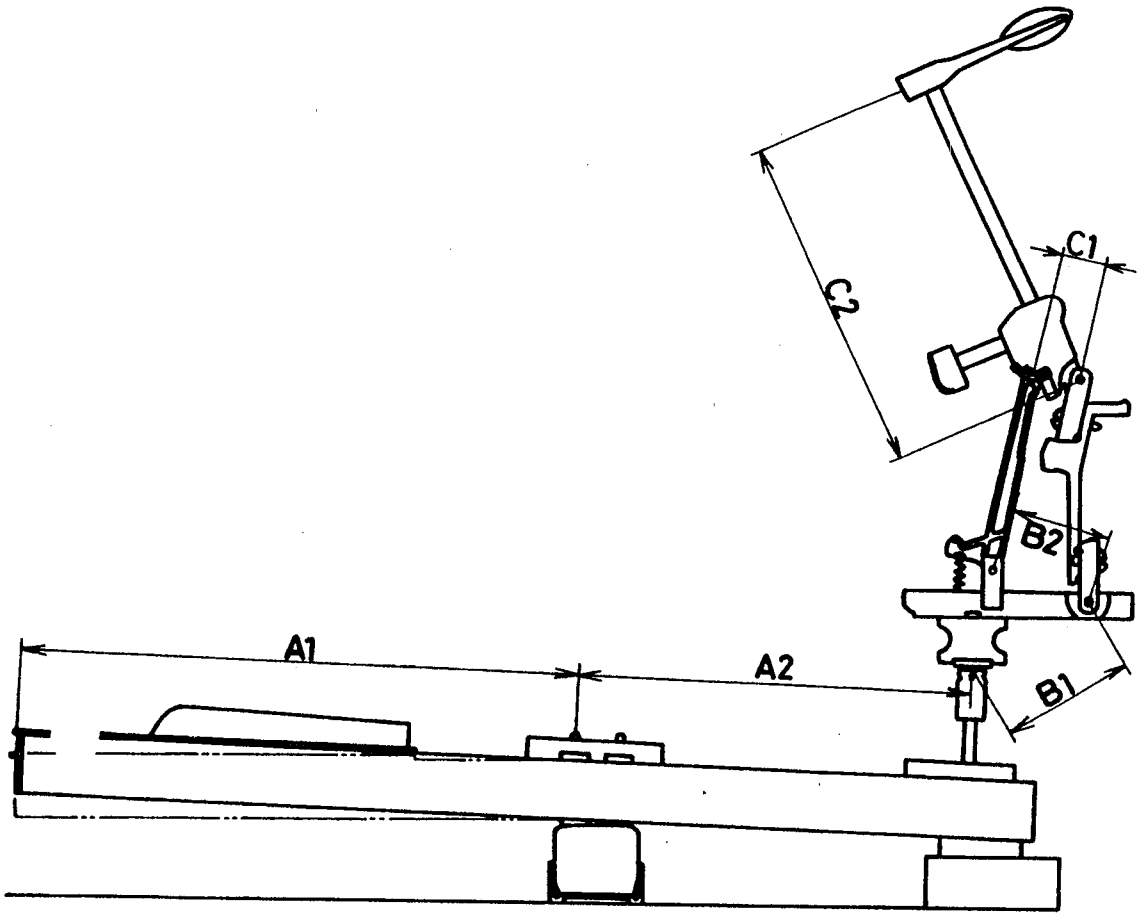
FIG. 2 illustrates a structure of a hammer action part of a general upright piano.
Figure 3:
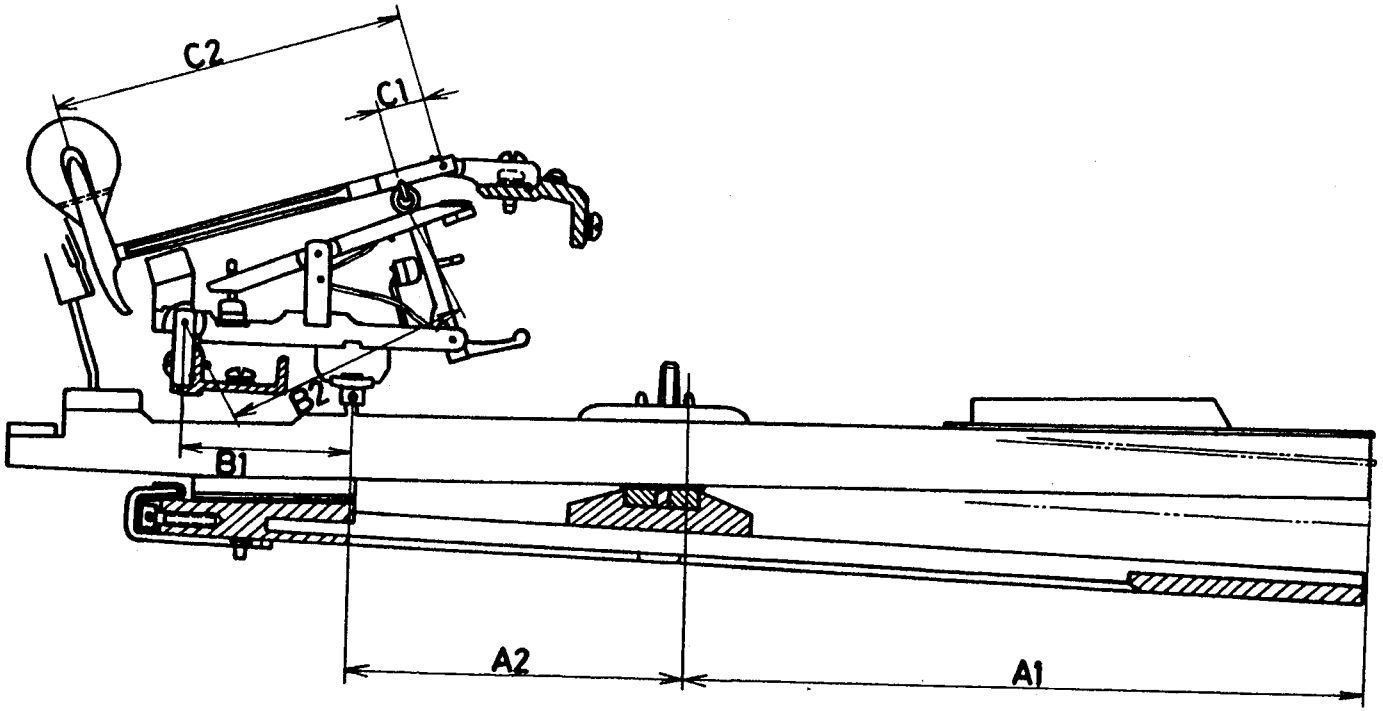
FIG. 3 illustrates a structure of a hammer action part of a general grand piano.

FIG. 2 and FIG. 3 illustrate key-action mechanisms of an upright piano and a grand piano. Signs A1 and A2 show lengths from a fulcrum of the key to a front edge thereof, and from the fulcrum to an actuator of the action mechanism, respectively. Signs B1 and B2 show lengths from the actuator of the action mechanism to a fulcrum thereof, and from the fulcrum of action to an action point of hammer mechanism respectively. Signs C1 and C2 show lengths from an action point of hammer mechanism to a fulcrum thereof, and from the fulcrum to a hit-string point, respectively. When the key is depressed, a ratio m of the velocity of the leading edge of the key to the velocity of the hammer is represented as follows.

$$m=(A2/A1)\times(B2/B1)\times(C2/C1)$$

The ratio m(r) for the reference piano is compared with the ratio m(p) for the automatic playing piano to convert the data. The converting ratio R is represented as $$R=m(p)/m(r).$$

Concretely, a string-striking velocity y is represented as $$y=-82.596 \log x_0+202.874-\Delta y$$

where the string-striking velocity before the converting is $x_0$, and the correction value is $\Delta y$. The correction value $\Delta y$ is represented as $$Ay=82.596 \log R.$$

Therefore, the automatic playing data that even the correction value related to the velocity difference between the depressed-key velocity and the string-striking velocity is considered is obtained.

This embodiment is such arranged as to convert the data according to only the length ratio in the hammer action part of the piano. It is possible that the data can be converted according to all factors which contribute to a sound of musical tones, such as a space between the photo sensors 22 for detecting the hammer speed, tension of the string, a size of a resonance board, and the like. The converting can be performed either at record timing or playback timing.

As described above, because the automatic playing data is converted as to correct the difference in a mechanism between the source piano for records and the automatic playing piano, the converted data allows the actual playing in the automatic playing piano to resemble the original playing in the source piano.

The conversion of the data can be performed at any timing, such as the record timing and the playback timing. If the conversion of the data relating to the mechanism is performed at the record timing, the automatic playing data is corrected in advance, axed thereby the automatic playing device having the corrected data can be applied to even the used pianos having no converting function.

What is claimed is:

1. A converting device of playing data in an automatic playing piano comprising:

detecting means for detecting a position of a hammer;

calculation means for calculating playing data depending on the detected position of a hammer;

correcting means for correcting the calculated playing data including a correction value of a piano;

recording means for recording the corrected data; and driving means for driving a key in accordance with the corrected data;

wherein said correction value is decided by an equation:

$$y=A \log(m(p)/(r))$$

where m(p) and m(r) respectively show ratios of an automatic playing piano and of a standard piano, and each of the ratios is represented as follows:

$$m=(A1/A2)*(B1/B2)*(C1/C2)$$

where A1 and A2 respectively show lengths from a fulcrum of a key to a front edge thereof and from the fulcrum to an actuator of an action mechanism, B1 and B2 respectively show lengths from the actuator to a fulcrum of the action and from the fulcrum of the action to an action point of a hammer, and C1 and C2 respectively show lengths from an action point of a hammer mechanism to a fulcrum thereof and from the fulcrum to a string striking point.

2. A converting device of playing data in an automatic playing piano comprising:

detecting means for detecting a position of a hammer;

calculation means for calculating playing data depending on the detected position of the hammer;

correcting means for correcting the calculated playing data including a correction value of a piano, said correction value comprising ratios comparing characteristics of an automatic playing piano and of a standard piano;

recording means for recording the corrected data; and driving means for driving a key in accordance with the corrected data.

3. A converting device according to claim 2, wherein said characteristics of said ratios comprise lengths from a fulcrum of a key to a front edge thereof and from the fulcrum to an actuator of an action mechanism, lengths from the actuator to a fulcrum of the action and from the fulcrum of the action to an action point of a hammer, and lengths from the action point of a hammer to a fulcrum thereof and from the fulcrum to a string striking point.

* * * * *